United States Patent [19]

Sakai et al.

[11] Patent Number: 4,605,057

[45] Date of Patent: Aug. 12, 1986

[54] PROCESS FOR PRODUCING CORE FOR CASTING

[75] Inventors: Junji Sakai, Ibaraki; Syogo Morimoto, Katsuta; Minoru Morikawa, Katsuta; Yoshitsugu Maehashi, Katsuta, all of Japan

[73] Assignee: Hitachi, Ltd., Tokyo, Japan

[21] Appl. No.: 520,518

[22] Filed: Aug. 4, 1983

[30] Foreign Application Priority Data

Aug. 6, 1982 [JP] Japan ..... 57-136264

[51] Int. Cl.[4] ..... B22C 1/02; B22C 9/00

[52] U.S. Cl. ..... 164/519; 164/520; 164/529; 106/38.3; 106/38.35; 106/38.9

[58] Field of Search ..... 164/516–519, 164/520, 529; 106/38.2, 38.3 X, 38.35 X, 38.9 X; 264/86

[56] References Cited

U.S. PATENT DOCUMENTS

| | | | |
|---|---|---|---|
| 3,222,737 | 7/1965 | Reuter | 164/518 |
| 3,692,086 | 9/1972 | Michelon | 164/516 |
| 3,776,992 | 12/1973 | Miki | 164/529 X |
| 3,857,712 | 12/1974 | Chevriot et al. | 106/38.3 X |
| 4,043,377 | 8/1977 | Mazdiyasni | 164/517 X |
| 4,117,055 | 9/1978 | Alexanderson | 264/86 X |
| 4,196,769 | 4/1980 | Feagin | 164/519 X |

FOREIGN PATENT DOCUMENTS

| | | | |
|---|---|---|---|
| 20848 | 2/1963 | Japan . | |
| 32822 | 10/1970 | Japan . | |
| 28687 | 7/1981 | Japan . | |
| 936129 | 9/1963 | United Kingdom | 164/518 |

*Primary Examiner*—Nicholas P. Godici

*Attorney, Agent, or Firm*—Antonelli, Terry & Wands

[57] ABSTRACT

A mold for casting particularly a core, is produced by mixing refractory particles with colloidal alumina to give a slurry, filling said slurry in a pattern having water absorption properties, solidifying the slurry, followed by drying and firing. The resulting mold, particularly core, has high dimensional accuracy with no cracks.

21 Claims, No Drawings

PROCESS FOR PRODUCING CORE FOR CASTING

BACKGROUND OF THE INVENTION

1. Field of the Invention

This invention relates to a process for producing a mold for casting using a slurry of refractory particles and colloidal alumina as binder. More particularly it relates to a process for producing a mold suitable for use as a core used in a precise casting mold cavity.

2. Description of the Prior Art

In making molds, particularly cores used in molds, there are used in general water glass, clays, plastics and the like as the binder. These binders have considerable binding strength and are stable at low temperatures, but their binding strength is lowered at high temperatures at 1200° C. or higher. Particularly when a fluid metal at high temperature is cast, there arises a defect in that the core is deformed and sometimes destroyed.

As a process for producing a heat resistant core, the use of a solution of hydrolyzed ethyl silicate as a binder is disclosed, for example, in Japanese Patent Appln Kokoku (Post-Exam Publn) No. 20848/63. According to this process, a hydrolyzed solution of ethyl silicate is mixed with refractory particles to prepare a slurry, which is filled in a pattern and gelled, followed by drying and firing. In order to proceed gelling, the pattern is sometimes dipped in water. Since an alcohol is used as binder and should be evaporated with the progress of gellation, there easily take place fine cracks in the mold in such a time. Thus, the strength of the mold is lowered by the generation of cracks.

In another process for producing a heat resistant mold, the use of moisture-containing colloidal alumina as the binder is disclosed, for example, in Japanese Patent Appln Kokoku (Post-Exam Publn) No. 32822/70. According to this process, silica sand particles coated with moisture-containing colloidal alumina are used as the molding material and filled in a pattern (or a core box) and compacted, followed by drying and firing after removal from the pattern. According to this process, fluidity of the sand is worse and no mold with high dimensional accuracy is obtained since compacting is conducted for producing the mold. Therefore, this process cannot be applied to cores with complicated shapes. Further, since compacting is necessary, the refractory particles should be coarse ones, which results in making the mold surface rough. Further, there arises another problem in that the packing density of the refractory particles changes at random in portions of the mold. In this process, if the water content increases in order to improve the fluidity of the sand, deformation of the mold takes place at the time of drying or firing.

SUMMARY OF THE INVENTION

It is an object of this invention to provide a process for producing a mold for casting overcoming the defects of the prior art mentioned above and having a desired shape and dimensions without causing cracks but with good dimensional accuracy. It is another object of this invention to provide a process for producing a mold having any kind of shape. It is a still further object of this invention to provide a process for producing a heat resistant mold for precise casting without bringing about destruction of the shape of the mold even if the mold is contacted with a fluid metal heated at 1200° C. or higher, e.g., 1200° C.–1600° C.

This invention provides a process for producing a mold for casting which comprises mixing refractory particles with a colloidal alumina solution as the binder to give a slurry, filling said slurry in a pattern (or pattern cavity) having water absorption properties, followed by drying and firing.

DESCRIPTION OF THE PREFERRED EMBODIMENTS

It was found that the slurry obtained by kneading refractory particles and colloidal alumina showed very good fluidity and when it was filled in a pattern cavity (or a core box), it was able to reach all the corners without causing voids even if the pattern had a complicated shape. Further, it was also found that when the slurry was filled in a pattern cavity having water absorption properties and allowed to stand without stirring, the viscosity of the slurry increased gradually. This invention has been accomplished by applying these phenomena newly found to the production of molds, particularly cores.

In this invention, refractory particles and colloidal alumina are mixed and kneaded to give a slurry, which is then poured or filled in a pattern (cavity) having a predetermined shape and water absorption properties; these procedures are essential in this invention. If the slurry is not filled in a pattern (cavity) having water absorption properties, the slurry does not form a solid. In order to solidify the slurry, removal of water from the slurry is necessary. In order to remove the water, the pattern having water absorption properties should be used.

As the pattern having water absorption properties, there can be used those made of plaster, synthetic resins having water absorption properties, metal plates having a large number of fine connected pores, or sintered bodies such as sintered metals or ceramics having a large number of fine connected pores, etc.

The pore size of the pattern having water absorption properties should be smaller than the particle size of the refractory particles. Since the particle size of the refractory particles is preferably 30 μm or more, the pore size of the pattern is preferably smaller than 30 μm.

As the filling method of slurry in the pattern (cavity), there can preferably be used a vibration method wherein the pattern is vibrated, or a method wherein the slurry is filled with application of pressure. By applying these methods, packing of refractory particles can be increased and molds and cores having complicated shapes can be produced with dimensional accuracy. As to the method of filling slurry with applying pressure, there can be employed a method wherein a vessel containing the slurry and an opening of the pattern (cavity) (or core box) for filling the slurry are connected with a pipe, through which the slurry can pass into the pattern (cavity) by the pressure applied to the slurry surface in the vessel by means of a gas such as air. The pressure applied to the slurry changes depending on the fluidity of slurry but usually is 0.1 to 2 kg/cm$^2$.

As to the vibration method, there can be employed a conventional vibrator. The direction of vibration may be either up-and-down or horizontal.

As the refractory particles, there can be used those generally used in making molds. Examples of the refractory material are zircon, alumina, sillimanite, quartz, mullite, magnesia, etc.

The particle size of the refractory particles is preferably 150 μm or less. It is more preferable to use refractory particles having a smaller particle size and those having a larger particle size as a mixture thereof. When a slurry obtained by kneading refractory particles having a smaller particle size and those having a larger particle size together with colloidal alumina is filled in the pattern (cavity) having water absorption properties, the refractory particles having a smaller particle size are gathered at the side contacting with the inner surface of the pattern (cavity), that is, the surface of the mold or core. As a result, the surface roughness of the mold (or core) is lessened and a smooth surface can be obtained. Further, since the mold contains the refractory particles having a larger particle size in larger amount in the inner portion and mechanical strength becomes smaller than that of the mold surface, destruction of the mold after casting becomes easy.

In precision castings, it is desired in most cases to give castings having surface roughness of 30 μm or less. In order to obtain castings having such smoothness, it is preferable to use refractory particles having a particle size of 80 μm or less. It is more preferable to use refractory particles having a particle size of 30 to 80 μm. When the particle size is smaller than 30 μm, mold release characteristics become worse and the mold surface tends to become rough.

On the other hand, the particle size of refractory particles having a larger particle size is preferably between 80 μm and 150 μm, more preferably 100 to 150 μm. If the particle size is too large, binding strength becomes undesirably lessened.

The mixing ratio of refractory particles having a smaller particle size to those having a larger particle size (smaller size/larger size) is preferably 6:4 to 7:3 by weight. By using such a mixture, the packing density of refractory particles on the mold surface can be made sufficiently high, the strength of the mold can be maintained and deformation of the mold can be lessened.

The colloidal alumina is a milky white viscous solution stable to inorganic acids and contains about 10% by weight of $Al_2O_3$ dispersed in a liquid dispersing medium (mainly water) in the form of rod of about 0.01 μm×0.1 μm (diameter×length) or in the form of fiber. The pH of the colloidal alumina is 3 to 5.

The slurry obtained by adding such colloidal alumina to refractory particles shows a good fluidity when stirred, but shows a phenomenon that the viscosity of the slurry gradually increases when the stirring is stopped.

It is preferable to add the colloidal alumina to the refractory particles in an amount of 20 to 40% by weight based on the weight of the refractory particles. If the amount is less than 20% by weight, the fluidity of the slurry becomes worse, while if the amount is larger than 40% by weight, there is a tendency to bring about shrinkage of the mold produced, which undesirably results in worsening dimensional accuracy. If colloidal silica is used in place of colloidal alumina, or a mixture of colloidal alumina and colloidal silica is used, cracks are formed on the mold produced or sink mark on the mold surface; this was ascertained by experiments.

It is possible to add a surface active agent to the slurry. By the addition of surface active agent, the viscosity of the slurry can be controlled to be maintained low when stirred so as to maintain the slurry state excellent in fluidity. It is preferable to use a surface active agent having the same pH as that of the colloidal alumina. As an example, the use of anionic surface active agent is preferable. When the pH of surface active agent is either higher or lower than the pH of the colloidal alumina, the effect of improving the fluidity of slurry is lessened.

It is preferable to use the surface active agent in an amount of 0.05 to 1% by weight based on the weight of the colloidal alumina. If the amount is too small, the effect of addition of the surface active agent cannot be obtained, while if the amount is too much, there easily takes place the formation of voids on the mold surface.

The surface active agent is preferably added after the addition of the colloidal alumina to the refractory particles. When the surface active agent is added, the slurry is kneaded sufficiently, followed by filling in the pattern (cavity) having water absorption properties. The slurry filled in the pattern (cavity) having water absorption properties increases its viscosity gradually. Further the water in the slurry is absorbed by the pattern having water absorption properties, resulting in setting gradually from the surface portion of the mold. The surfaces of refractory particles seem to be coated with colloidal alumina coating layers, which bind individual refractory particles.

When the slurry is solidified, the resulting solid is, then, fired. In such a case, if the solidified mold is not sufficiently dried and contains water, the mold is sometimes broken during the firing. In order to prevent this, when the mold is not dried sufficiently, it is preferable to heat the mold at lower temperatures for drying at the initial stage of firing. If the mold is dried sufficiently before the firing, such a heating step for drying can be omitted.

The heating temperature for drying is preferably 100° C. or higher. In such a case, when the temperature is raised from room temperature to 100° C. or higher instantly, there is a fear for breaking the mold. Therefore, it is preferable to heat the mold initially at about 50° C., more preferably 30° to 60° C., for about 1 to 5 hours, followed by heating at between 100° C. and 250° C. The drying can be conducted while placing the resulting mold in the pattern (cavity) or after removing the mold from the pattern (cavity).

Firing is conducted for removing water of hydration of colloidal alumina, and for removing unnecessary ingredients mixed in the course of production of the mold by heating the mold at a temperature at least as high as the temperature of a liquid metal when casting the liquid metal in the mold.

Therefore, the firing temperature should be at least the temperature of removing the water of hydration of colloidal alumina or higher. Since the temperature of removing the water of hydration of colloidal alumina is about 680° C., the firing temperature should be 680° C. or higher. Preferable firing temperature is a temperature higher than the pouring temperature of a liquid metal. Further, since the purpose of firing is not sintering of the refractory particles, too high a temperature is not necessary. Instead, since the mold after casting is required to be destructible and the refractory particles are required to be used repeatedly, it is preferable to make the firing temperature lower than the sintering temperature of the refractory particles.

The firing can be conducted under an oxidizing atmosphere, such as air. The firing can be conducted while retaining the mold in the pattern (cavity) or after removing the mold from the pattern (cavity).

By the firing, the colloidal alumina becomes alumina. The resulting alumina functions as a binder for binding individual refractory particles and said effect as a binder does not deteriorate up to near 1600° C.

The mold or core produced by the procedures mentioned above has excellent heat resistance and the shape thereof is not destroyed even if contacted with a liquid metal heated at 1200° to 1600° C. Further, cracks are not formed on the mold surface during the molding or pouring of a liquid metal. Further, since the shrinkage of the mold is very small, castings having high dimensional accuracy, more concretely within a dimensional variation of ±0.25 mm, can be produced.

In the production of ceramic sintered bodies such as silicon carbide, there is known slip casting wherein a slurry containing ceramic is poured into a mold having water absorption properties, and the slurry is then hardened by removing water therefrom then subjected to sintering (e.g. Japanese Patent Appln Kokoku (Post-Exam Publn) No. 28687/81). But this process does not employ a binder and sintering is necessary for binding ceramic particles, so that this process cannot be applied to a process for producing a mold for metal casting.

This invention is illustrated by way of the following Examples, in which all percents are by weight unless otherwise specified.

EXAMPLE 1

Production of gas turbine buckets using a mold produced by the process of this invention as a core.

A core was produced by using zircon having a particle size of 37 to 53 μm (average 45 μm) as refractory particles and a plaster pattern as pattern having water absorption properties as follows.

To 1 kg of zircon particles, 250 g of colloidal alumina (25% based on the weight of the zircon particle) was added and sufficiently kneaded in a kneader (a propeller mixer, revolution number 500 rpm) to give a slurry having good fluidity. The slurry was poured into a plaster pattern cavity, wherein the water in the slurry was absorbed into the plaster and the slurry was set. The solidified core was placed in an electric furnace together with the plaster and heated at 50° C. for 3 hours. After removing the plaster pattern out of the furnace, the remaining core was heated at 200° C. for 2 hours for drying, followed by firing at 1000° C. for 2 hours. After cooling, the desired core was obtained.

The resulting core was set in a predetermined place in a mold having a shape of a gas turbine bucket. Wax was poured around the core by using an injection molding machine to give a wax pattern having the shape of a gas turbine bucket. An oil was sprayed previously on the inner surface of the mold in order to improve mold release of wax. After removal of the wax pattern from the mold, the pattern was equipped with a feeder head, a runner, a gate, and the like. The oils attached to the surface of the pattern were removed by cleaning using a mixed solution of acetone and an alcohol.

The thus produced wax pattern was dipped in a slurry containing zircon particles and colloidal silica to attach the slurry around the pattern surface. Further, before the attached slurry was dried, molten quartz having a size of 100–150 mesh was sprinkled over the mold surface. The coating procedures of the wax mold surface with the slurry and the molten quartz were conducted in a constant temperature chamber at 25° C. The particle size of zircon in the slurry was 37 to 53 μm and the amount of colloidal silica was 40%. The thickness of the coating obtained by the slurry and the molten quartz was 0.2 to 0.3 mm in total. The procedures of attaching the slurry on the wax mold surface and sprinkling of quartz were repeated 10 times, respectively. The particle size of quartz was changed to 20 to 50 mesh from the sprinkling of the second time and thereafter.

After forming the zircon particle layers and the quartz layers on the wax mold surface, the wax was melted out in an autoclave under a pressure of 8–10 kg/cm$^2$, followed by firing at 1000° C. for 2 hours to give the desired mold.

Into the resulting mold, a nickel-base alloy was poured. The composition of the nickel-base alloy was carbon 0.1%, silicon 0.30%, manganese 0.20%, aluminum 3.7%, cobalt 9.0%, chromium 16.3%, iron 0.5%, molybdenum 2.0%, balance being nickel and impurity elements contaminating at the time of melting.

The melting and pouring of the nickel-base alloy was conducted in vacuum as follows. A vacuum vessel was divided into two, i.e. upper and lower chambers. In the upper chamber, a melting furnace was installed. The mold was placed in the lower chamber and made removable to the upper chamber. Both the upper and lower chambers were kept in vacuum of $3\times10^{-4}$ torr. The nickel-base alloy was melted in the melting furnace in the upper chamber. The mold was placed in the lower chamber until the nickel-base alloy was melted, while the mold was heated at 1000° C. therein. After the nickel-base alloy was melted, the mold was moved to the upper chamber. The molten nickel-base alloy was poured into the mold at the pouring temperature of 1470° C. After the molten alloy was agglomerated in the mold, the mold was moved downwardly to the lower chamber and allowed to cool to room temperature as it was. Then the mold and the resulting casting was removed from the lower chamber and the mold was disjointed.

The mold on the surface of the resulting casting was removed by sand blast and the core was removed by high-pressure jet water of 700 kg/cm$^2$. The dimensional accuracy of the resulting gas turbine bucket was ±0.25 mm. Since the dimensional accuracy according to the process disclosed in Japanese Patent Appln Kokoku (Post-Exam Publn) No. 20848/63 wherein the hydrolyzed ethyl silicate solution is used to ±0.5 mm, the dimensional accuracy by using the core obtained by the process of this invention is remarkably high. Further, the surface appearance of the resulting gas turbine bucket was very smooth and sufficiently satisfactory.

EXAMPLE 2

Production of an impeller for a pump using a mold produced by the process of this invention.

To 1.2 kg of zircon particles having a particle size of 53–63 μm, 0.8 kg of quartz having a particle size of 150–350 μm was added and mixed to give a refractory material for a core. To this material, 640 g of colloidal alumina and an anionic surface active agent in an amount of 0.1% based on the weight of the colloidal alumina were added and kneaded well in a mixer to give a slurry having good fluidity. The resulting slurry was filled in a plaster pattern cavity while vibrating the plaster pattern up and down by a vibrator. The slurry was allowed to stand for 24 hours for hardening. The resulting core was removed from the pattern cavity and allowed to stand in a room for one night and day. Then the core was placed in a drying furnace and heated from room temperature to 200° C. in 4 hours and maintained at 200° C. for 3 hours. Then, the core was fired at 700° C. for 5 hours.

An outer mold (an outer mold consisting of cope and drag) was made as follows. A mixture of zircon having a particle size of 63–74 μm and zircon having a particle size of 105–150 μm in a weight ratio of 7:3 was prepared as refractory particles in an amount of 10 kg. As the binder, a mixture of colloidal alumina and colloidal silica in a weight ratio of 6:4 was used in an amount of 600 g. A mixture of the above-mentioned refractory particles and this binder was used as the molding material and molded into the outer mold by compacting.

In the outer mold, the above-mentioned core was set. Then, the resulting mold was heated to give 800° C. in an electric furnace. When the mold temperature was raised to 600° C., a molten 13 chromium cast steel was poured into the mold at the pouring temperature of 1600° C. After cooling the mold, the resulting casting was removed therefrom and shaking out was conducted by shot blast. The core was removed by dissolving it by dipping in molten sodium hydroxide at 600° C. for 1 hour.

The composition of 13 chromium cast steel was carbon 0.3%, manganese 0.8%, silicon 1.0%, chromium 13.0%, nickel 0.6%, balance being iron and impurities.

The casting was cut and the quality of inner portion was tested. There was no defect in the inner portion. The dimensional accuracy at the outlet portion of the pump impeller was ±0.25 mm and the surface roughness was 5–8 μm. Since the dimensional accuracy according to the process disclosed in Japanese Patent Appln Kokoku (Post-Exam Publn) No. 20848/63 wherein the hydrolyzed eithyl silicate solution is used is ±0.5 mm, and the surface roughness 15–35 μm, the casting obtained by using the core obtained by the process of this invention is excellent in dimensional accuracy and surface smoothness.

COMPARATIVE EXAMPLE

Cores were produced in the same manner as described in Example 1 except for using colloidal silica in place of colloidal alumina, or using a mixture of colloidal silica and colloidal alumina in place of colloidal alumina in the slurry for producing the core. No complete cores were produced in individual cases, since cracks were produced in the cores.

As mentioned above, according to the process of this invention, molds, particularly cores, having good heat resistance, dimensional accuracy and surface smoothness can be produced easily. Thus, there is no fear of deformation of the mold or core at the time of pouring a liquid metal thereinto and there can be produced castings having high dimensional accuracy and surface smoothness. Further, since the molding materials are used in the form of a slurry, moldability is excellent and variations caused by workers are very slight.

What is claimed is:

1. A process for producing a core for casting which comprises mixing refractory particles with colloidal alumina to give a slurry, filling said slurry in a cavity of a pattern made of a synthetic resin that has a property of absorbing water, whereby the slurry is formed into a solid due to removal of water from said slurry containing colloidal alumina by said pattern made of said synthetic resin, followed by drying and firing.

2. A process according to claim 1, wherein the slurry is filled in the cavity of the pattern under pressure.

3. A process according to claim 1, wherein the slurry is filled in the cavity of the pattern while vibrating the pattern.

4. A process according to claim 1, wherein the colloidal alumina content in the slurry is 20 to 40% by weight based on the weight of the refractory particles.

5. A process according to claim 2, wherein the slurry contains 20 to 40% by weight of colloidal alumina based on the weight of the refractory particles, and said slurry is filled in the cavity of the pattern by applying a pressure of 0.1 to 2 kg/cm$^2$ to the slurry.

6. A process according to claim 1, wherein the refractory particles are a mixture of finer particles having a particle size of 80 μm or less and coarser particles having a particle size of 100 μm or more.

7. A process according to claim 6, wherein the finer particles have a particle size of larger than 30 μm.

8. A process according to claim 6, wherein the mixture contains the finer particles and the coarser particles in a weight ratio of the finer particles to the coarser particles = 7:3 to 6:4.

9. A process according to claim 1, wherein the refractory particles have a particle size of 30 to 150 μm.

10. A process according to claim 1, wherein the pattern is made of bodies having a large number of fine connected pores.

11. A process according to claim 10, wherein the refractory particles have a particle size of at least 30 μm, and the pores of said bodies have pore sizes less than 30 μm.

12. A process according to claim 1, wherein said colloidal alumina contains $Al_2O_3$ in the form of rods or fibers.

13. A process according to claim 1, wherein said colloidal alumina has a pH of 3–5.

14. A process for producing a core for casting which comprises mixing refractory particles, 20 to 40% by weight of colloidal alumina based on the weight of the refractory particles, and 0.05 to 1% by weight of a surface active agent based on the weight of the colloidal alumina to give a slurry, filling said slurry in a cavity of a pattern made of a synthetic resin that has a property of absorbing water, whereby the slurry is formed into a solid due to removal of water from said slurry containing colloidal alumina by said pattern made of said synthetic resin, followed by drying and firing.

15. A process for producing a core for casting which comprises mixing refractory particles with 20 to 40% by weight of colloidal alumina based on the weight of the refractory particles to give a slurry, filling said slurry in a cavity of a pattern made of a synthetic resin that has a property of absorbing water, solidifying the slurry due to removal of water from said slurry containing colloidal alumina by said pattern made of said synthetic resin, heating the solidified product at a temperature of 30° to 60° C. for drying, followed by firing.

16. A process according to claim 15, wherein the drying is conducted in a furnace together with the pattern after the solidification of the slurry in the cavity of the pattern.

17. A process for producing a core for casting which comprises mixing refractory particles with 20 to 40% by weight of colloidal alumina based on the weight of the refractory particles and 0.05 to 1% by weight of a surface active agent based on the weight of the colloidal alumina to give a slurry, filling said slurry in a cavity of a pattern made of a synthetic resin that has a property of absorbing water, solidifying the slurry due to removal of water from said slurry containing colloidal alumina by said pattern made of said synthetic resin, heating the solidified product at a temperature of 30° to 60° C. and then at a temperature of 100° C. or higher for drying, followed by firing.

18. A process for producing a core for casting which comprises mixing refractory particles having a particle size of at least 30 μm with colloidal alumina to give a slurry, filling said slurry in a cavity of a pattern made of a material that has a property of absorbing water, said pattern being made of bodies having a large number of fine connected pores, the pores of said bodies having pore sizes less than 30 μm, whereby the slurry is formed into a solid due to removal of water from said slurry containing colloidal alumina by said pattern made of said material, followed by drying and firing.

19. A process for producing a core for casting which comprises mixing refractory particles, having a particle size of at least 30 μm, 20 to 40% by weight of colloidal alumina based on the weight of the refractory particles, and 0.05 to 1% by weight of a surface active agent based on the weight of the colloidal alumina to give a slurry, filling said slurry in a cavity of a pattern made of a material that has a property of absorbing water, said pattern being made of bodies having a large number of fine connected pores, the pores of said bodies having pore sizes less than 30 μm, whereby the slurry is formed into a solid due to removal of water from said slurry containing colloidal alumina by said pattern made of said material, followed by drying and firing.

20. A process for producing a core for casting which comprises mixing refractory particles, having a particle size of at least 30 μm, with 20 to 40% by weight of colloidal alumina based on the weight of the refractory particles to give a slurry, filing said slurry in a cavity of a pattern made of a material that has a property of absorbing water, said pattern being made of bodies having a large number of fine connected pores, the pores of said bodies having pore sizes less than 30 μm, solidifying the slurry due to removal of water from said slurry containing colloidal alumina by said pattern made of said material, heating the solidified product at a temperature of 30 to 60° C. for drying, followed by firing.

21. A process for producing a core for casting which comprises mixing refractory particles, having a particle size of at least 30 μm, with 20 to 40% by weight of colloidal alumina based on the weight of the refractory particles and 0.05 to 1% by weight of a surface active agent based on the weight of the colloidal alumina to give a slurry, filling said slurry in a cavity of a pattern made of a material that has a property of absorbing water, said pattern being made of bodies having a large number of fine connected pores, the pores of said bodies having pore sizes less than 30 μm, solidifying the slurry due to removal of water from said slurry containing colloidal alumina by said pattern made of said material, heating the solidified product at a temperature of 30° to 60° C. and then at a temperature of 100° C. or higher for drying, followed by firing.

* * * * *